US011384607B2

(12) United States Patent
Wright

(10) Patent No.: US 11,384,607 B2
(45) Date of Patent: Jul. 12, 2022

(54) MOTION COMPENSATING FLOOR SYSTEM AND METHOD

(71) Applicant: David C. Wright, Spring, TX (US)

(72) Inventor: David C. Wright, Spring, TX (US)

( * ) Notice: Subject to any disclaimer, the term of this patent is extended or adjusted under 35 U.S.C. 154(b) by 0 days.

(21) Appl. No.: 17/316,415

(22) Filed: May 10, 2021

(65) Prior Publication Data

US 2021/0262298 A1 Aug. 26, 2021

Related U.S. Application Data

(63) Continuation-in-part of application No. 16/462,149, filed as application No. PCT/US2017/062392 on Nov. 17, 2017, now Pat. No. 11,002,089.

(60) Provisional application No. 62/423,238, filed on Nov. 17, 2016.

(51) Int. Cl.
*E21B 19/09* (2006.01)
*E21B 19/00* (2006.01)
*E21B 19/10* (2006.01)

(52) U.S. Cl.
CPC ..... *E21B 19/006* (2013.01); *E21B 19/10* (2013.01)

(58) Field of Classification Search
CPC ..... E21B 19/006; E21B 19/09
USPC ..... 166/355; 405/202, 224.4
See application file for complete search history.

(56) References Cited

U.S. PATENT DOCUMENTS

| | | | |
|---|---|---|---|
| 4,215,950 | A | 8/1980 | Stevenson |
| 4,886,397 | A | 12/1989 | Cherbonnier |
| 5,310,007 | A | 5/1994 | Parikh |
| 6,554,072 | B1 | 4/2003 | Mournian et al. |
| 7,025,553 | B1 | 4/2006 | Thomas et al. |
| 2008/0031692 | A1 | 2/2008 | Wybro et al. |
| 2011/0017695 | A1 | 1/2011 | Vandenbulcke et al. |
| 2011/0280668 | A1 | 11/2011 | Norwood |
| 2012/0207550 | A1 | 8/2012 | Aksel et al. |
| 2012/0241164 | A1 | 9/2012 | Coles |
| 2014/0186125 | A1 | 6/2014 | Andresen et al. |
| 2015/0368992 | A1 | 12/2015 | Pallini |

FOREIGN PATENT DOCUMENTS

| | | |
|---|---|---|
| CN | 103498642 | 1/2014 |
| EP | 2617918 B1 | 5/2006 |
| WO | WO2011133552 A1 | 10/2011 |

*Primary Examiner* — Sunil Singh

(74) *Attorney, Agent, or Firm* — Matthews, Lawson, McCutcheon & Joseph, PLLC

(57) ABSTRACT

A motion compensating system is usable on a vessel during well intervention operations through a riser. The system includes a first floor; a second floor; a plurality of hydraulic cylinders connecting the first floor to the second floor; a bearing retainer attachable to the second floor; a spherical bearing provided between the second floor and the bearing retainer, wherein the spherical bearing includes a central opening therethrough for the riser to allow angular movement of the riser relative to the first and second floors; an insert bearing sleeve at least partially located inside the central opening of the spherical bearing; and a slip bowl attachable to the insert bearing sleeve. Each of the first floor, the second floor, the bearing retainer, the insert bearing sleeve and the slip bowl have an opening therethrough for the riser, and each opening is aligned with the central opening of the spherical bearing.

13 Claims, 16 Drawing Sheets

Section A-A

Section A-A

Section B-B

MOTION COMPENSATING FLOOR SYSTEM AND METHOD

REFERENCE TO RELATED APPLICATIONS

The present application is a Continuation in Part of U.S. patent application Ser. No. 16/462,149, which is a National Phase application of PCT Application No. 2017/62392, filed Nov. 17, 2017, which claims priority to and the benefit of U.S. Provisional Application No. 62/423,238, filed 17 Nov. 2016, and entitled "Motion Compensating Floor System and Method." The contents of the above-referenced applications are incorporated herein by reference in their entireties.

FIELD

Embodiments usable within the scope of the present disclosure relate, generally, to systems and methods usable to compensate for relative motion between a vessel, a work platform, and subsea riser. More specifically, embodiments usable within the scope of the present disclosure include low cost, portable, and reusable systems and methods for reducing or eliminating relative motion caused by wind, waves, sea swells, and/or underwater currents, experienced between a vessel, a work floor or platform, and/or a subsea riser while performing well intervention, subsea equipment installation, and similar operations from the work floor or platform.

BACKGROUND

Conventional operations upon, through, and/or using a subsea riser generally require the use of a rig or platform, which is stabilized against a large portion of the heave motions and other forces and/or movements created by ocean currents, winds, and other natural conditions. Alternatively or additionally, various motion compensation systems can be used in association with the risers to prevent relative movement between the riser and an operational structure to prevent damage to the riser and/or the structure. Even when the riser is stabilized in such a manner, movement of a vessel, platform, or rig, used to access the riser, can hinder or eliminate the ability to perform various operations, and/or cause damage. Thus, conventional approaches require most subsea operations (e.g., acid injections and stimulations, decommissioning, hydrate remediation, plugging and abandonment operations, etc.) to be performed using a platform that provides sufficient stability and performance characteristics necessary for such operations. As such, relative movement between a subsea riser and an operational platform or similar structure must be strictly limited.

A need exists for systems and methods usable for accessing and performing operations upon, through, and/or using a subsea riser that can be performed riglessly, e.g., using a marine vessel in lieu of a conventional rig or platform, for enabling lower cost and faster operations that require less time for setup and deconstruction procedures.

A need also exists for systems and methods usable to perform such operations by compensating for environmental conditions, such as wind, waves, water swells, and other forces imparted to marine vessels and/or the subsea riser, which cause relative motions (e.g., heave, pitch, roll, and yaw) that are greater in magnitude than those experienced by larger platforms or other floating production facilities.

A further need exists for systems and methods that overcome the shortcomings of conventional motion compensating systems, which accommodate only a limited range of relative motion and only along limited axes.

Conventional compensation systems are rigidly integrated into the frame, deck, and/or hull of a structure. After completion of subsea operations, such an assembly cannot be removed and/or transported quickly and easily, to enable replacement with other job specific tools. An additional need exists for systems and methods that are less expensive, more efficient, portable, and able to be used and transported between vessels and operational sites as needed.

A need exists for systems and methods capable of dampening, or even eliminating, relative motion between a riser, a vessel, and equipment located on the vessel, such as a coiled tubing stack or similar conduit, thus preventing relative motion between a riser and an inner tubular string extending within the riser.

Embodiments usable within the scope of the present disclosure meet these needs.

Figure 1:
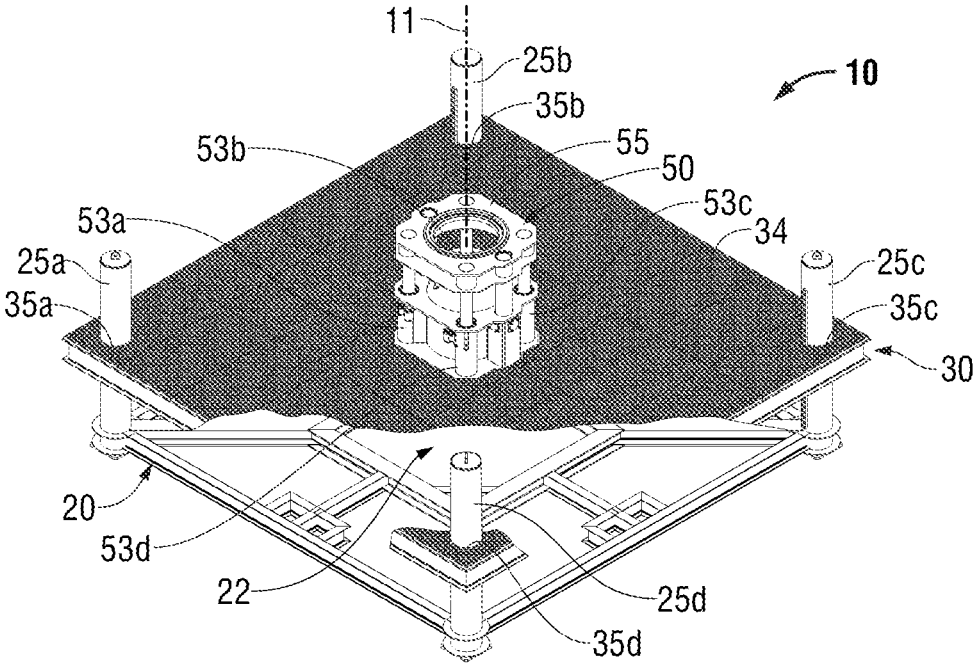
FIG. 1 depicts an isometric view of an embodiment of a motion compensating floor system usable within the scope of the present disclosure.

The present embodiments are detailed below in reference to the figures as listed above.

SUMMARY

Embodiments usable within the scope of the present disclosure include apparatuses, systems, and methods for compensating for the motion of a vessel so as to prevent damage to a riser.

One embedment involves a motion compensating system usable on a vessel during well intervention operations through a riser. The motion compensation system comprises: a first floor; a second floor; a plurality of hydraulic cylinders connecting the first floor to the second floor; a bearing retainer attachable to the second floor; a spherical bearing provided between the second floor and the bearing retainer, wherein the spherical bearing includes a central opening therethrough for the riser to allow angular movement of the riser relative to the first floor and the second floor; an insert bearing sleeve at least partially located inside the central opening of the spherical bearing; and a slip bowl attachable to the insert bearing sleeve, wherein each of the first floor, the second floor, the bearing retainer, the insert bearing sleeve and the slip bowl have an opening therethrough for the riser, and each opening is aligned with the central opening of the spherical bearing.

In an embodiment, each of the plurality of hydraulic cylinders is pivotally connected to the first floor and the second floor for moving the first floor with respect to the second floor.

In an embodiment, the first plurality of hydraulic cylinders are connected to the first floor around the opening of the first floor, and are connected to the second floor around the opening of the second floor.

In an embodiment, a total of three hydraulic cylinders connect the first floor to the second floor.

In an embodiment, the first floor is configured to be attached to a deck or hull of the vessel over a moon pool of the vessel.

In an embodiment, the vessel is a jack-up boat.

In an embodiment, the insert bearing sleeve and the slip bowl move angularly with the angular movement of the riser.

In an embodiment, the spherical bearing comprises an outer ring and a spherical inner ring, and the outer ring is encased between the bearing retainer and the second floor.

Another embodiment is directed to a method for compensating for relative motion between a vessel, a heave floor unit, and a subsea riser platform. The method comprises: attaching the heave floor unit to a deck or hull of the vessel, the heave floor unit comprising: a first floor that is attached to the deck or hull, a second floor, and a plurality of hydraulic cylinders connecting the first floor to the second floor; a bearing retainer attached to the second floor; a spherical bearing provided between the second floor and the bearing retainer, wherein the spherical bearing includes a central opening therethrough for the riser to allow angular movement of the riser relative to the heave floor unit; an insert bearing sleeve at least partially located inside the central opening of the spherical bearing; and a slip bowl attached to the insert bearing sleeve, wherein each of the first floor, the second floor, the bearing retainer, the insert bearing sleeve and the slip bowl have an opening therethrough that is aligned with the central opening of the spherical bearing. The method further includes inserting the subsea riser through the central opening of the spherical bearing and the opening of the first floor, the second floor, the bearing retainer, the insert bearing sleeve and the slip bowl; and actuating the plurality of hydraulic cylinders in response to motion of the vessel relative to the second floor, and in response to motion of the heave floor unit relative to the angular movement the subsea riser.

In an embodiment, the plurality of cylinders are actuated to keep the second floor at a constant level, and to keep the subsea riser at a constant tension.

In an embodiment, the step of actuating the plurality of hydraulic cylinders comprises differentially actuating individual hydraulic cylinders within the plurality of hydraulic cylinders in response to a pitch motion, a roll motion, a yaw motion, or combinations thereof, by the vessel.

In an embodiment, the heave floor unit is attached to the deck or hull of the vessel over a moon pool of the vessel.

In an embodiment, the heave floor unit is attached to a cantilever portion of the vessel.

The foregoing is intended to give a general idea of the invention, and is not intended to fully define nor limit the invention. The invention will be more fully understood and better appreciated by reference to the following description and drawings.

DETAILED DESCRIPTION

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Embodiments usable within the scope of the present disclosure relate to a motion compensating floor system, which can be portable or usable on existing vessels or platforms that experience motion, e.g., motion of the sea water. For example, an embodiment of the floor system can include a single compensating platform, thus limiting the total height of the system and providing a compact, portable system that can be lifted (e.g., via a crane), placed over a moon pool or similar feature of a vessel or a platform, and attached to the deck or other suitable part of the vessel or platform. Prior to installation, one should consider variables such as the vessel or platform type, the weight of the riser, water depth, time of the year or season, and water conditions typically encountered in the geographical region. After completion of intervention operations, the floor system can be removed from the vessel for transport to another site.

It is well known that certain conditions produce calm seas. While other conditions, such winter weather, can produce high seas that are significantly more choppy or rough. These conditions cause the vessel to heave, pitch, roll and/or yaw. Unlike a riser used on rig or a platform connected to the sea floor, the movement of the vessel or a floating platform caused by the sea can overload, or even break, the riser. Even if the riser does not fail, high loads can fatigue the riser and reduce operational life. As such, the motion compensating floor system disclosed herein can reduce or eliminate relative motion between the riser and the operational or work area on the vessel adjacent to the riser during deployment of subsea packages, slickline, coiled tubing, and other downhole or deepwater equipment for intervention and other operations, such as snubbing, performed upon, through, and/or using a subsea riser. Lastly, the floor system can further reduce or eliminate relative motion between the intervention tools within the riser caused by the heave, pitch, roll, and yaw motions of the vessel.

Figure 2A:
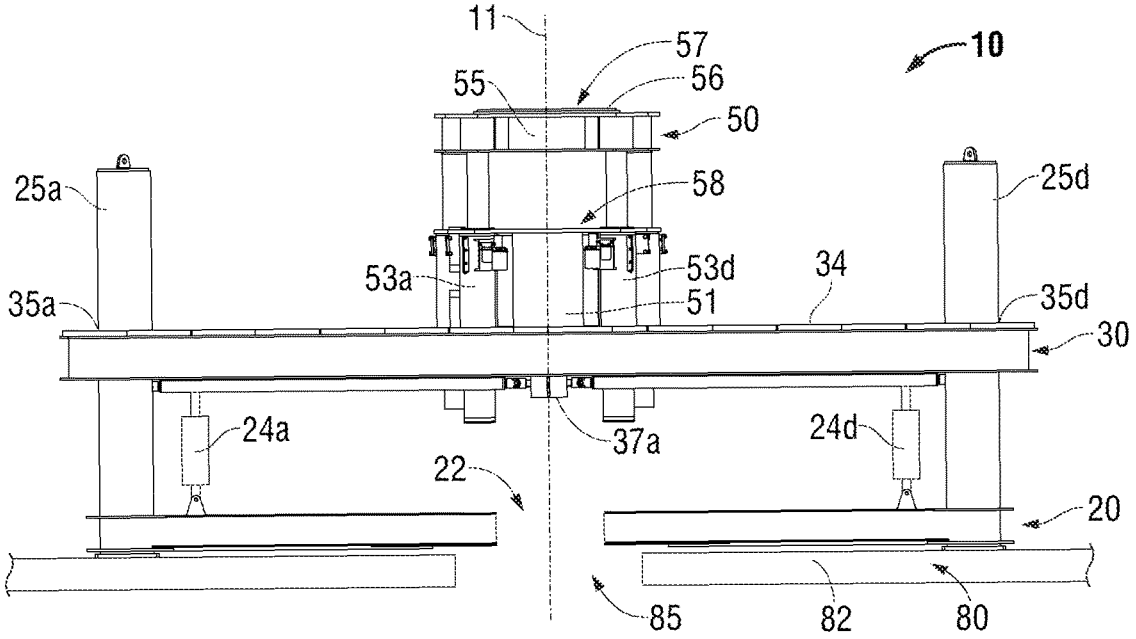
FIG. 2A depicts a side elevational view of the motion compensating floor system depicted in FIG. 1.
Figure 2B:
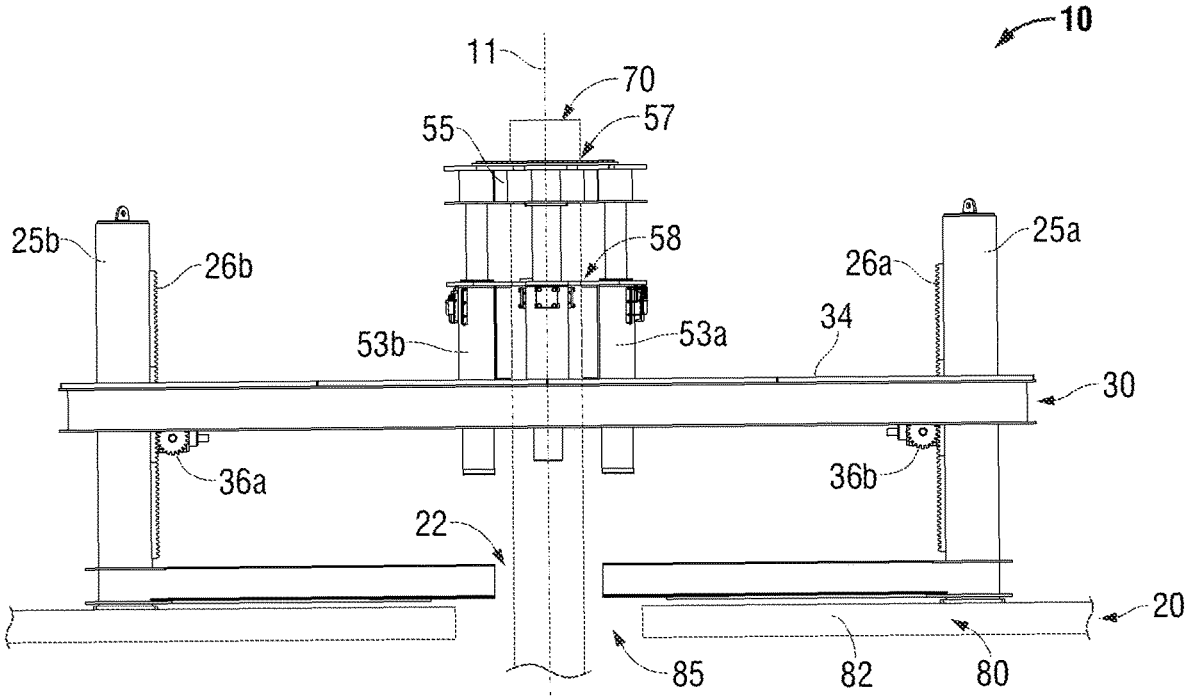
FIG. 2B depicts a front elevational view of the motion compensating floor system depicted in FIG. 1.

FIG. 1 depicts an isometric view of an embodiment of a motion compensating floor system (10), hereinafter referred to as the floor system, usable within the scope of the present disclosure. FIGS. 2A and 2B depict front and side views of the floor system (10), respectively. The depicted embodiment of the floor system (10) includes a base (20), shown as a frame adapted for positioning and/or attachment to a deck of a vessel (80, see FIG. 8) or a similar structure, having an open area (22) (e.g., a central space) for accommodating positioning of a riser or another device therethrough. The base (20) can comprise a plurality of beams or other structural elements adapted for maintaining structural integrity of the floor system (10) and for supporting other portions of the floor system (10). The base (20) can further comprise four guide shafts (25*a-d*) or posts extending at each corner thereof, wherein the guide shafts (25*a-d*) are adapted to guide and/or limit the motion of a floor (30).

The floor (30) is shown positioned above the base (20) and movable relative to the base (20) along the guide shafts (25*a-d*). Similarly to the base (20), the floor (30) can comprise a plurality of beams or other structural elements adapted for maintaining structural integrity of the floor (30) while supporting other portions of the floor system (10) and/or various downhole and subsea equipment positioned thereon. The floor (30) further comprises an open area (e.g., a central space) (32, see FIG. 3) at the center of the floor (30) for accommodating a riser or another device therethrough. Each guide shaft (25*a-d*) is depicted passing through a respective guide bore (35*a-d*) extending through the floor (30) at each corner thereof, such that the guide shafts (35*a-d*) permit vertical movement of the floor (30) relative to the base (20), while preventing pitch, roll, rotational, and/or horizontal (i.e., lateral) movements relative to the base (20).

The four guide shafts (25*a-d*) are depicted in FIGS. 1, 2A, and 2B as generally tubular members passing through a respective generally circular guide bores (35*a-d*) extending through the movable floor (30). However, it should be understood that the guide shafts (25*a-d*) can include any number and type of guiding members without departing from the scope of the present disclosure. In an embodiment, an outer surface of the guide shafts (25*a-d*) and/or the inside surface of the guide bores (35*a-d*) can be used to guide the movement of the floor (30) relative to the base (20). Specifically, the guide bores (35*a-d*) can include tube segments (not shown) welded or otherwise attached to the floor (30). The tube segments can have an inside diameter larger than the outside diameter of the guide shafts (25*a-d*), such that the tube segments are adapted to slide about the guide shafts (25*a-d*) to form a metal-to-metal linear bearing for guiding the movement of the floor (30). In another embodiment of the floor system (10), the guide bores (35*a-d*) can contain one or more linear ball bearings (not shown), located on the inside diameter thereof, which can further reduce the friction between the guide shafts (25*a-d*) and the guide bores (35*a-d*) while maintaining stable vertical motion.

While the base (20) is shown as a generally square-shaped, truss structure, formed from a plurality of metal support beams, it should be understood that other embodiments (not shown) of the floor system (10) can comprise a base (20) having other shapes and/or dimensions, and any structural features, as necessary, to support a movable floor (30) and to engage the deck, hull, or other portion of a vessel. Similarly, while the floor (30) is shown as a generally square-shaped, two-dimensional platform, comprising a plurality of metal support beams and an upper surface (34) (e.g., a screen, mesh, panels, plates, or any other generally durable material) adapted for accommodating personnel and well equipment thereon, other embodiments (not shown) of the floor system (10) can comprise a floor (30) having other shapes, dimensions, and/or materials without departing from the scope of the present disclosure.

FIG. 2A further depicts the floor (30) adapted for movement with respect to the base (20) by way of four hydraulic cylinders (24*a-d*, 24*b* and 24*c* are hidden from view) or other linear actuators. The hydraulic cylinders (24*a-d*) can be pivotally mounted to the base (20) and the floor (30) and be usable to raise and lower the floor (30) away from and toward the base (20), responsive to movement of the vessel (see FIG. 7) or other structure upon which the floor system (10) is installed. FIG. 2B depicts additional means for moving and/or guiding the floor (30) toward and away from the base (20). The floor system (10) is shown comprising rotatable gears (36*a-d*, 36*c* and 36*d* hidden from view) connected by drive shafts with motors (37*a-b*, see FIG. 2A, 37*b* hidden from view), which rotate the gears (36*a-d*) to engage a rack (26*a-d*, 26*c* and 26*d* hidden from view) (e.g., a toothed bar) positioned along each guide shaft (25*a-d*) to move and/or guide the floor (30) along the guide shafts (25*a-d*). It should be understood that the motors (37*a-b*) can include electrical motors, hydraulic motors, or any other rotary actuators known in the art.

Referring again to FIGS. 1, 2A, and 2B, a riser tensioner (50) is shown positioned at the center of the floor (30) within the open area (32) and fixably secured to the floor (30). The riser tensioner (50) is depicted comprising an upper portion and a lower base portion, with a central axis (11) extending longitudinally through the riser tensioner (50). The lower base portion comprises a tubular body (51) with a central space or cavity (58) and four hydraulic cylinders (53*a-d*) positioned generally equidistantly along the length of the tubular body (51). The rod ends of the hydraulic cylinders (53*a-d*) can be connected to an upper portion of the riser tensioner (50), which can be moved by the hydraulic cylinders (53*a-d*) toward and away from the tubular body (51). The upper portion of the riser tensioner can comprise a connector bracket (55) having a ring shaped configuration with a space or cavity (57) at the center thereof. The connector bracket (55) can be adapted to receive slips or mechanical grippers (not shown) or comprise other means known in the art for fixably connecting the connector bracket (55) with a riser (70) extending through the cavities (57, 58). FIG. 2B shows the riser (70) further extending through the open areas (22, 32) of the base (20) and the floor (30), respectively, and through a moon pool (85) below the deck (82) of a vessel.

Figure 8:
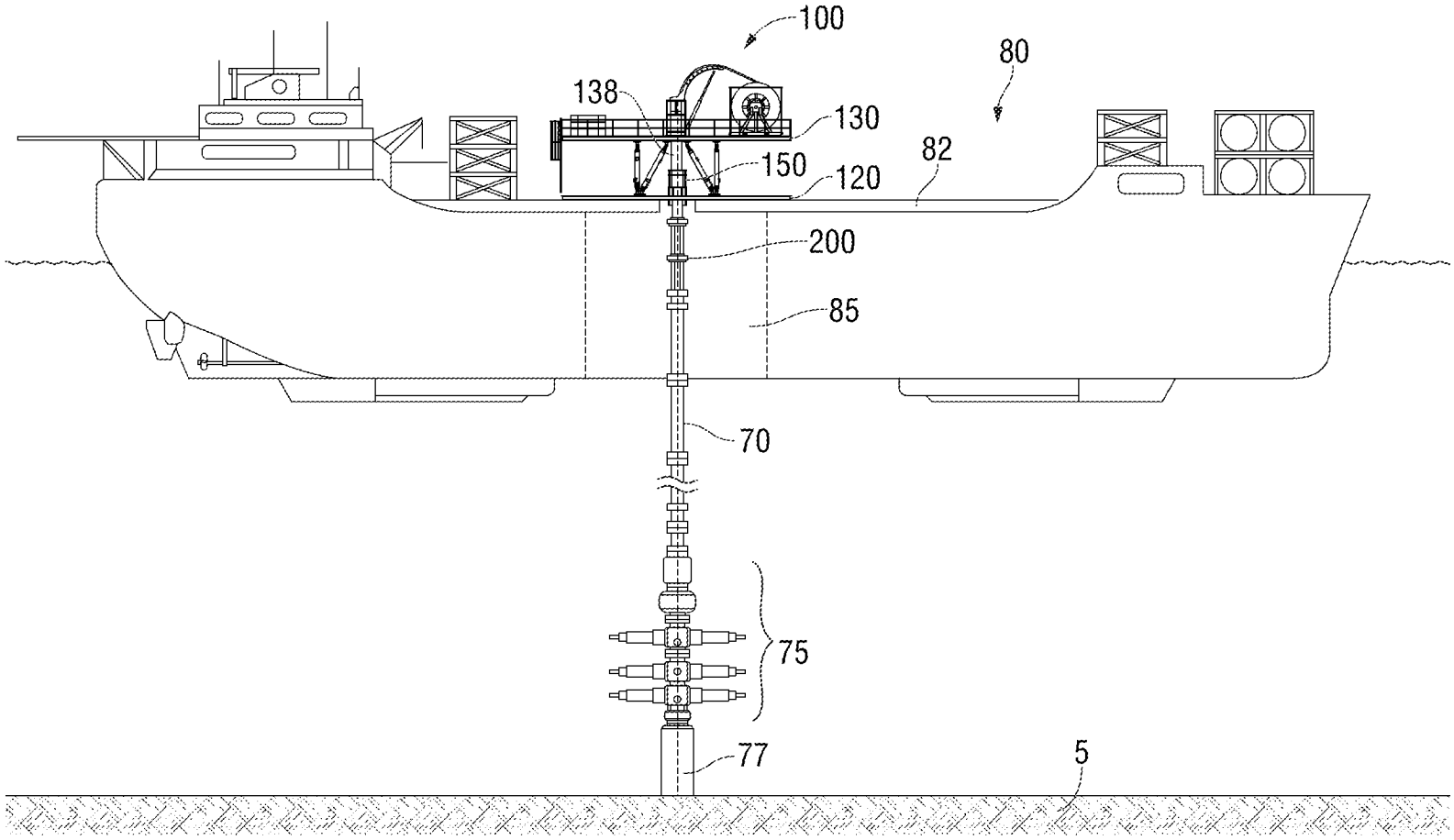
FIG. 8 depicts a partial diagrammatic side view of the motion compensating floor system depicted in FIG. 5, positioned on a vessel and in connection with a subsea riser.

Referring again to FIGS. 2A and 2B showing the floor system (10) positioned on the deck (82) of the vessel (80) over the moon pool (85). As stated previously, during operations, the floor system (10) can stabilize the floor (30) with respect to the riser (70) as the vessel (80) moves due to environmental conditions around it. For example, as the vessel (80) experiences heave, pitch, and/or roll motion due to movement of the sea water, the floor hydraulic cylinders (24*a-d*) can be used to maintain the floor (30) in a generally constant position relative to the riser (70), which may be connected to the sea floor (5), as depicted in FIG. 8. Similarly, the hydraulic cylinders (53*a-d*) of the riser tensioner (50) can be used to maintain the riser (70) at a constant and/or appropriate tension. Thus, as the relative vertical position between the vessel (80) and the riser (70) decreases or increases, the floor hydraulic cylinders (24*a-d*) and the riser tensioner hydraulic cylinders (53*a-d*) can simultaneously extend or retract, eliminating or decreasing changes in such relative position between the floor (30) and the riser (70), while maintaining proper tension on the riser (70). The limits of the system to compensate for relative vertical movement are defined by the sum of the maximum combined strokes of the two sets of cylinders (24*a-d*, 53*a-d*). Therefore, longer strokes can allow the system to compensate for larger heaving motions.

In addition to vertical heave stabilization, the floor system (10) can also compensate for vessel pitch, roll, and yaw motions through independent actuation of selected floor hydraulic cylinders (24*a-d*), enabling the floor (30) to be maintained in a generally fixed angular position relative to the riser (20), as the angular orientation of the vessel changes. The shape and/or dimensions of the guide bores (35*a-d*) and/or guide shafts (25*a-d*), as well as the stroke lengths of floor hydraulic cylinders (24*a-d*) can be selected to enable a desired range of angular movement between the base (20) and the floor (30).

Figure 3:
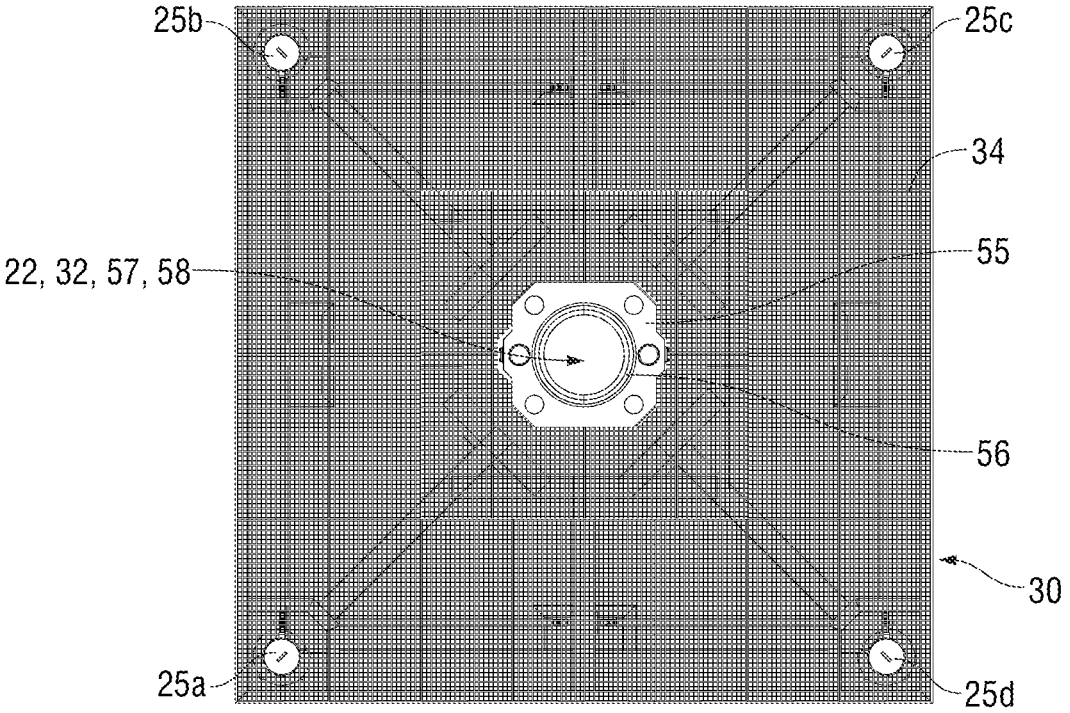
FIG. 3 depicts a top view of the motion compensating floor system depicted in FIG. 1.

Referring now to FIG. 3, depicting a top view of the floor system (10) usable within the scope of the present disclosure. Specifically, the Figure depicts the spherical roller bearing (56) secured within the connector bracket (55), which is positioned over the upper surface (34) of the floor (30). The central cavities (57, 58) of the riser tensioner (50) are shown concentrically positioned with the open areas (22, 32) of the base (20) and the floor (30). The figure further depicts the upper end of the guide shafts (25*a-d*).

Figure 4:
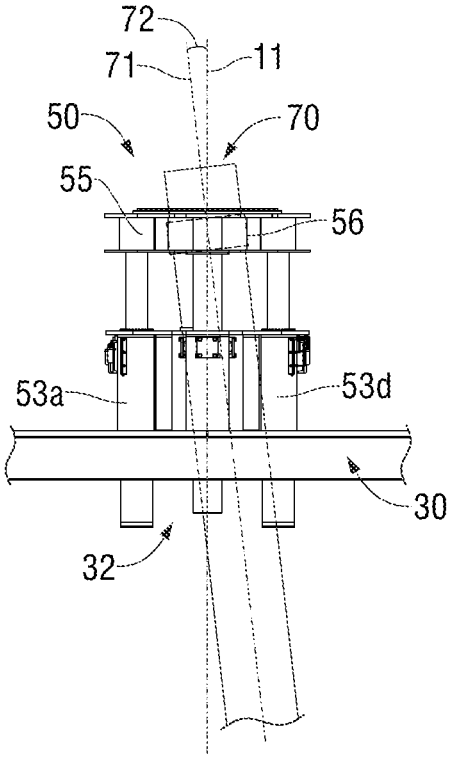
FIG. 4 depicts a diagrammatic side view of an embodiment of a riser tensioner of the motion compensating floor system depicted in FIGS. 1 and 5.

In an embodiment of the floor system (10), the riser tensioner (50) can also reduce structural loads and bending moments due to relative rotation, yaw, pitch, and roll motions between the riser (70) and the vessel (80). Referring now to FIG. 4, showing a diagrammatic side view of an embodiment of the riser tensioner (50) within the scope of the present disclosure. The Figure depicts the connector bracket (55) of the riser tensioner (50) comprising a spherical roller bearing (56), or a gimble, positioned therein to allow relative angular and/or rotational motion between the riser tensioner (50) and the riser (70) secured therein. For example, as the vessel (80) changes orientation, the riser (70) can remain in a generally fixed angular position due to the relative rotation permitted by the spherical roller bearing (56). In this manner, the vessel (80) can be oriented (e.g., rotated to face a desired direction) without introducing torsion or other stresses or requiring that the connection between the riser tensioner (50) and the riser (70) be released.

Furthermore, the roller bearing also permits angular movement of the riser (70) relative to the riser tensioner (50). Specifically, FIG. 4 depicts a riser angularly offset (72) with respect the riser tensioner, wherein a central axis (71) of the riser (20) is angularly offset (72) from the central axis (11) of the riser tensioner (50). The shape and/or dimensions of the open areas (22, 32) within the base (20) and floor (30), as well as the dimensions of the riser tensioner (50) can be selected to permit a desired range of relative angular movement between the riser (70) and the riser tensioner (50), the floor (30), and/or the base (20), wherein the range of movement between the riser (70) and the riser tensioner (50), the floor (30), and/or the base (20) can be limited by the diameter of the open space (22, 32).

Figure 5:
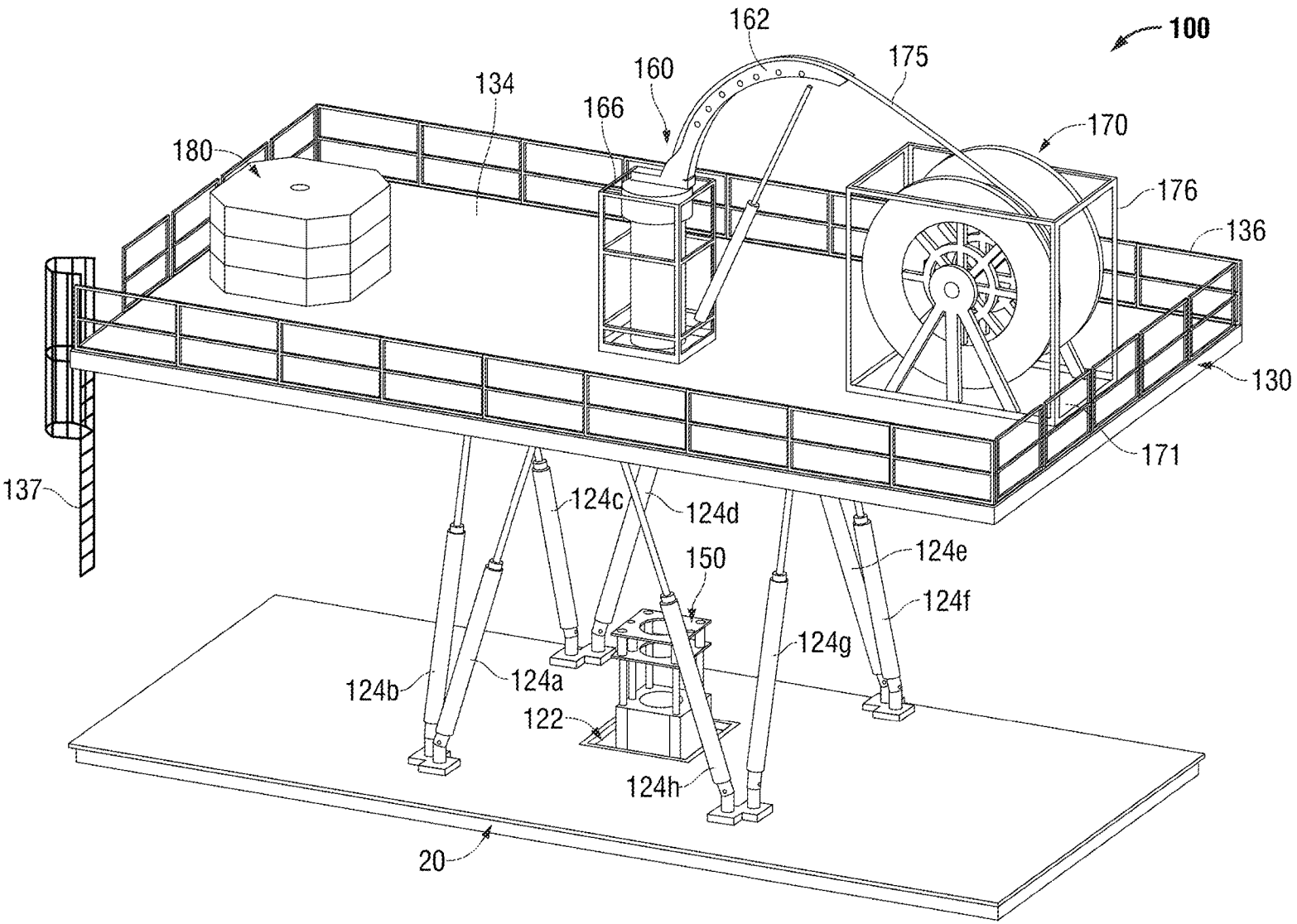
FIG. 5 depicts an isometric view of another embodiment of a motion compensating floor system usable within the scope of the present disclosure.

Referring now to FIG. 5, showing an isometric view of another embodiment of a floor system (100) within the scope of the present disclosure. Similarly to the previously described floor system (10), the floor system (100) depicted in FIG. 5, comprises a base (120) adapted for attachment to the deck of a vessel or a platform that experiences motion. The base (120) is shown comprising a generally rectangular configuration with an open area (122) (e.g., a space) at the center thereof for accommodating a riser or another device therethrough. Although the base (120) is shown comprising a solid plate, the base (120) can comprise a framework of beams or other structural elements adapted for maintaining structural integrity of the floor system (100) and for supporting upper portions of the floor system (100). FIG. 5 further depicts a riser tensioner (150) positioned within the open area (120) and fixably secured to the load bearing portions of the base (120). The riser tensioner (150) depicted in FIG. 5 can have the same or similar configuration as the riser tensioner (50) previously described.

FIG. 5 further depicts a floor (130) positioned above the base (120) and supported by a plurality of fluid cylinders (124*a-h*). The floor (130) is shown comprising a generally rectangular configuration with a central open space (132) at the center thereof. The floor (130) is shown comprising a framework of beams or other structural elements adapted for maintaining structural integrity of the floor (130) while supporting various downhole and/or subsea equipment thereon. The floor (130) further comprises an open area (132) (e.g., a space) at the center thereof for accommodating positioning of a riser and/or another device therethrough. While the floor (130) is shown as a generally rectangular-shaped, two-dimensional platform, comprising a plurality of metal support beams and an upper surface (134) (e.g., a screen, mesh, panels, plates, or any other generally durable material) adapted for accommodating personnel and well equipment thereon, the floor (130) can comprise any shape, dimensions, and/or materials without departing from the scope of the present disclosure. The floor (130) can further include a safety railing system (136) extending above the outer edges of the floor (130). Lastly, the floor (130) can also include a ladder (137) or a staircase (not shown) usable by personnel for moving between the base (20) or the deck (82, see FIG. 8) area and the floor (130).

Figure 6A:
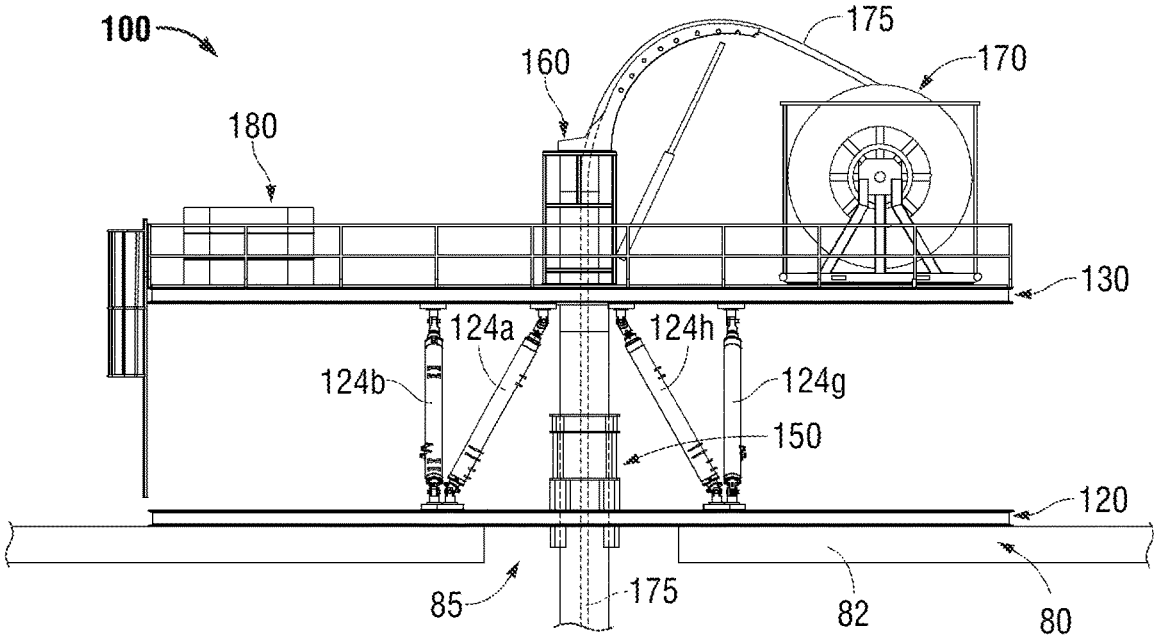
FIG. 6A depicts a side elevational view of the motion compensating floor system depicted in FIG. 5, with a first plurality of cylinders shown in a fully retracted position.
Figure 6B:
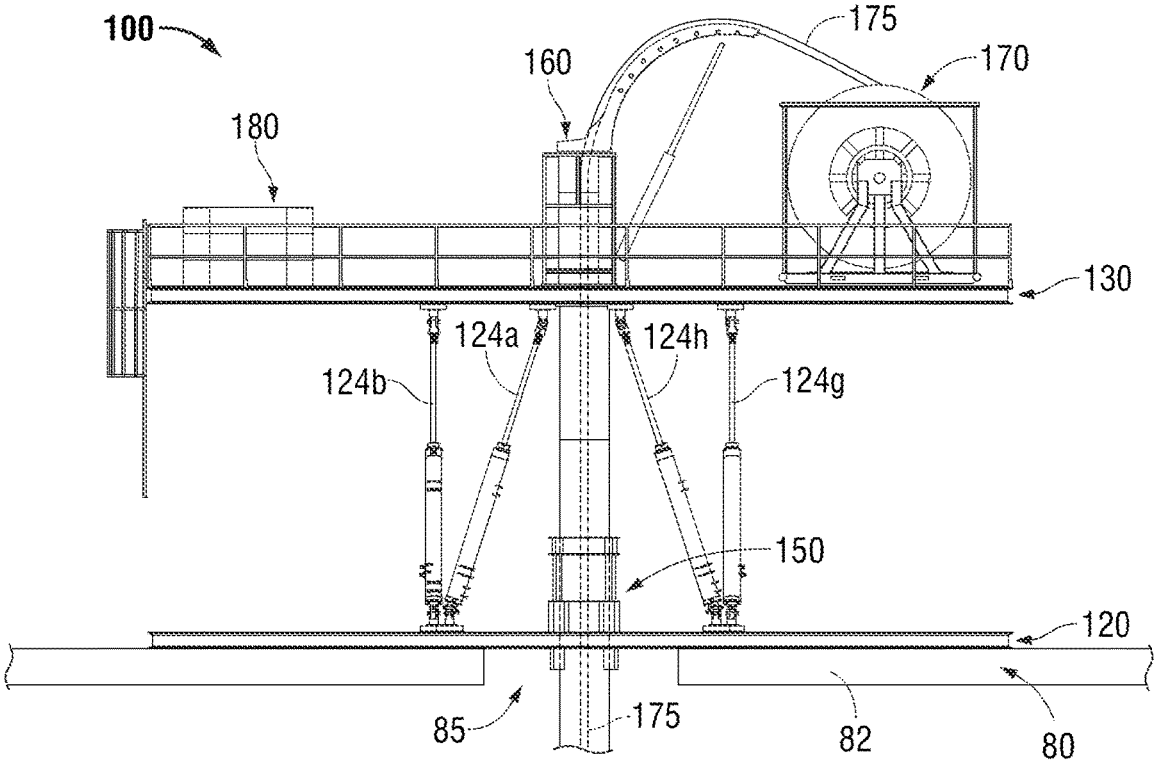
FIG. 6B depicts a side elevational view of the motion compensating floor system depicted in FIG. 5, with the first plurality of cylinders shown in a fully extended position.

FIGS. 5, 6A, and 6B, further depict the floor (130) comprising a coiled tubing system thereon, wherein the coiled tubing system includes equipment required to run coiled tubing operations. The equipment depicted includes a coiled tubing reel (170) to store and transport coiled tubing, an injector head (160) to provide the tractive effort to run and retrieve the coiled tubing, and a power pack (not shown)

that generates the necessary hydraulic and/or pneumatic power required to operate the injector head (160), the reel (170), and/or the plurality of fluid cylinders (124*a-h*). The injector head (160) can incorporate profiled chain assemblies (not shown) to grip the coiled tubing (175) and a hydraulic drive system that provides the tractive effort for running and retrieving the coiled tubing from the riser. The gooseneck (162) portion of the injector head (160) mounted on top of the injector head feeds the coiled tubing (175) from the reel (170) around a controlled radius into the injector head (160). The coil tubing injector (160) is shown positioned within the open area (132) of the floor (132) fixably secured to the load bearing portions of the floor (130) framing. Such positioning allows coiled tubing (175) to be directed through the injector head (160) and the floor (130) toward and through the riser tensioner (150). The coil tubing injector (160) further comprises an outer guard (166) usable to protect the coil tubing injector (160) from equipment and other objects being moved about the upper surface (134) of the floor (130).

The coiled tubing reel (170) is a device usable to store and transport coiled tubing (175) for communicating fluids therethrough. The coiled tubing reel (170) can incorporate an internal manifold and swivel arrangement (not shown) to enable various fluids to be pumped through the coiled tubing (175) at any time. The reel (170) is shown comprising a base (171) usable for fixably connecting the reel (170) to the upper surface (134) of the floor (130). The reel (170) further comprises an outer guard (176) usable to protect the coil tubing injector (160) from equipment and other objects being moved about the upper surface (134) of the floor (130).

The injector head (160) and the reel (170) disclosed herein are well known in the art and it is believed that further description of their structure and operation is not necessary for one skilled in the art to practice the apparatus and the method of the present disclosure.

FIGS. 5, 6A, and 6B, further depict a counterweight (180) positioned on one side of the floor (130), namely on the opposite side of the floor (130) with respect to the coiled tubing reel (170). The counterweigh (180) comprises a plurality of stackable plates or other weight members usable to compensate for or counterbalance the weight of the coiled tubing reel (170), which can contain thousands of feet of coiled tubing (175). The weight of the reel (170) can induce significant pivoting forces upon the floor (130), which, in turn, can impede or prevent the desired controlled movement of the floor (130) during operations. The counterweight (180) can be fixably connected to the floor (130) by any known means to prevent the counterweight from sliding or otherwise moving about the upper surface (134) of the floor (130) during operations. In another embodiment (not shown) of the floor system (10), the counterweight (180) can be slidably or otherwise movably positioned on the floor (130), wherein an actuator (not shown), such as a hydraulic cylinder, can move the counterweight (180) toward and away from the reel (170) or the center of the floor (130) to compensate for the changing weight of the reel (170) as the coiled tubing (175) is pushed into the riser or rewound back onto the reel (170).

Referring still to FIGS. 5, 6A, 6B, and 7 the Figures further depict the floor (130) adapted for movement with respect to the base (120) by way of the plurality of hydraulic cylinders (124*a-h*) or other linear actuators. The hydraulic cylinders (124*a-h*) are usable to raise and lower the floor (130) away from and toward the base (120), responsive to movement of the vessel (80, see FIG. 8) deck, hull, or other structure upon which the base (120) is installed. The Figures show the hydraulic cylinders (124*a-h*) extending laterally between the base (120) and the floor (130). Specifically, the cap ends of the hydraulic cylinders (124*a-h*) are shown pivotally connected to the base (120) at four locations arranged in an essentially square pattern around the riser tensioner (150), wherein each set of two hydraulic cylinders is connected to the base at each of the four locations. The rods of the hydraulic cylinders (124*a-h*) are shown pivotally connected to the floor (130) at eight locations arranged in an essentially octagonal pattern around the coiled tubing injector (160). The configuration of the cylinders between the base (120) and the floor (130) results in four sets of two cylinders arranged in a V-shaped formation. The depicted cylinder configuration provides improved stability and motion control of the floor (130), allowing heave, pitch, roll, and yaw motion compensation.

Although the hydraulic cylinders (124*a-h*) are shown connected in a specific configuration, it should be understood that other cylinder configurations or arrangements can be used without departing from the scope of the present disclosure. Furthermore, it should be understood that cylinder stroke lengths and dimensions, bore sizes, the number of cylinders used, as well as the hydraulic fluid pressures and flows required to properly operate the system can be varied depending on specific desired load and/or reaction times (e.g., based on the riser and expected forces/motions), the vessel with which the system is to be used, and other variables. Cylinders designed to be powered by other fluids, such as air or nitrogen, are also usable within the scope of the present invention. Due to the properties of nitrogen which allow rapid movement of the cylinders, nitrogen is the preferred fluid for use in the cylinders.

Figure 7:
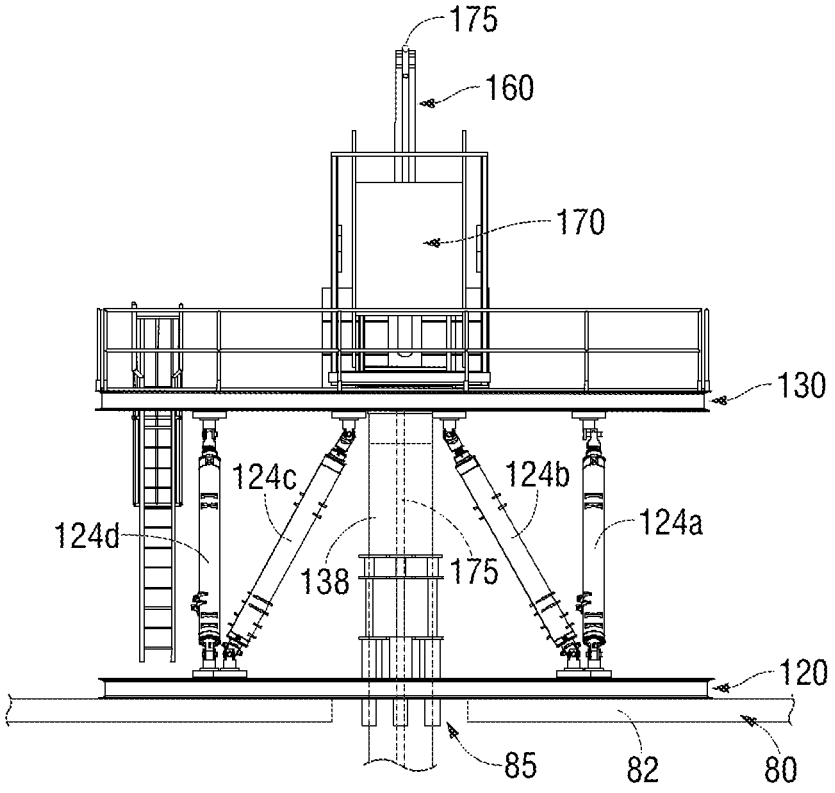
FIG. 7 depicts a front elevational view of the motion compensating floor system depicted in FIG. 5, with a first plurality of cylinders shown in a fully retracted position.

Referring to FIGS. 5 and 8, during operations, the hydraulic cylinders (124*a-h*) can extend and retract simultaneously to compensate for the heave motion of the vessel (80). For example, if the vessel (80) moves closer to the sea floor (5) because it enters the trough of a wave, the hydraulic cylinders (124*a-h*) can extend upward, thereby moving the floor (130) upward, to compensate for the downward displacement of the base (120). If the vessel moves away from the sea floor (5) because it enters the crest of a wave, cylinders (124*a-h*) can retract, thereby moving floor (130) downward, to compensate for the upward displacement of base (120). Additionally, due to placement of the coiled tubing reel (170) on the movable floor (130), relative movement between the riser (70) and the coiled tubing (175) positioned within the riser (70) can be reduced or eliminated, as the floor (130) maintains the coiled tubing reel (170) at the same position with respect to the riser (70). Without motion compensation, the movement of the vessel (80) can cause the coiled tubing (175) to move within the riser (70) and potentially damage the riser (70) and other tools positioned therein. FIGS. 6A and 7 depict the hydraulic cylinders (124*a-h*) in the fully retracted position, while FIGS. 5 and 6B depict the hydraulic cylinders (124*a-h*) in the fully extended position.

To compensate for pitch, roll, and yaw motions of the vessel (80), the hydraulic cylinders can be extended and retracted independently from each other to change the tilt or the vertical angle of the floor surface (134) with respect to the base (120) to reduce or eliminate the motion of the floor surface (134) as the vessel tilts or changes the vertical angle.

In addition, the riser tensioner (150) can maintain the riser (70) at a proper tension. Specifically, when the vessel (80) heaves up and down, the riser tensioner cylinders (53*a-d*, see FIG. 1) retract and extend in unison to prevent the riser from being crushed due to excessive compression or being strained or disconnected due to excessive tension. Furthermore, excessive tension or compression of the riser (70) can cause damage to other subsea equipment that is connected with the riser (70).

During operations, the distance between the base (120) and the floor (130) will change as the floor system (100) compensates for the heaving motion of the vessel (80). A slip joint (138) can be incorporated into the floor system (100) between the coiled tubing injector (160) and the riser tensioner (150) to maintain the coiled tubing (175) and other downhole tools enclosed therein. Specifically, the slip joint (138) can comprise two conduit sements concentrically positioned to allow longitudinal telescopic retraction and extension while maintaining a seal therebetween. The upper end of the slip joint (138) can be positioned within or about the open area (132) and be connected with the load bearing members of the floor (130). The lower end of the slip joint (138) can be positioned within the cavity (57) of the connector bracket (55) or in connection with the connector bracket (55). Accordingly, the slip joint (138) can allow the coiled tubing (175) to be fed from the coiled tubing injector (160) into the riser tensioner (150) while enclosing the coiled tubing (175) therein.

Referring again to FIG. 8, showing one example of the floor system (100) installed on a vessel (80). Specifically, the figure shows a partial-cross-sectional side view of a vessel (80) with the floor system (100) positioned on the deck (82), with the riser tensioner (150) connected to a riser (70). The riser (70) is shown extending through a moon pool (85) of the vessel (80) toward the sea floor (5), where the riser (70) can be connected to a blowout preventer (BOP) stack positioned over a wellhead (77). An optional external cylindrical heave compensator (200) can be connected between the riser tensioner (150) and the riser (70) to further compensate for the heave motion of the vessel (80).

Figure 9:
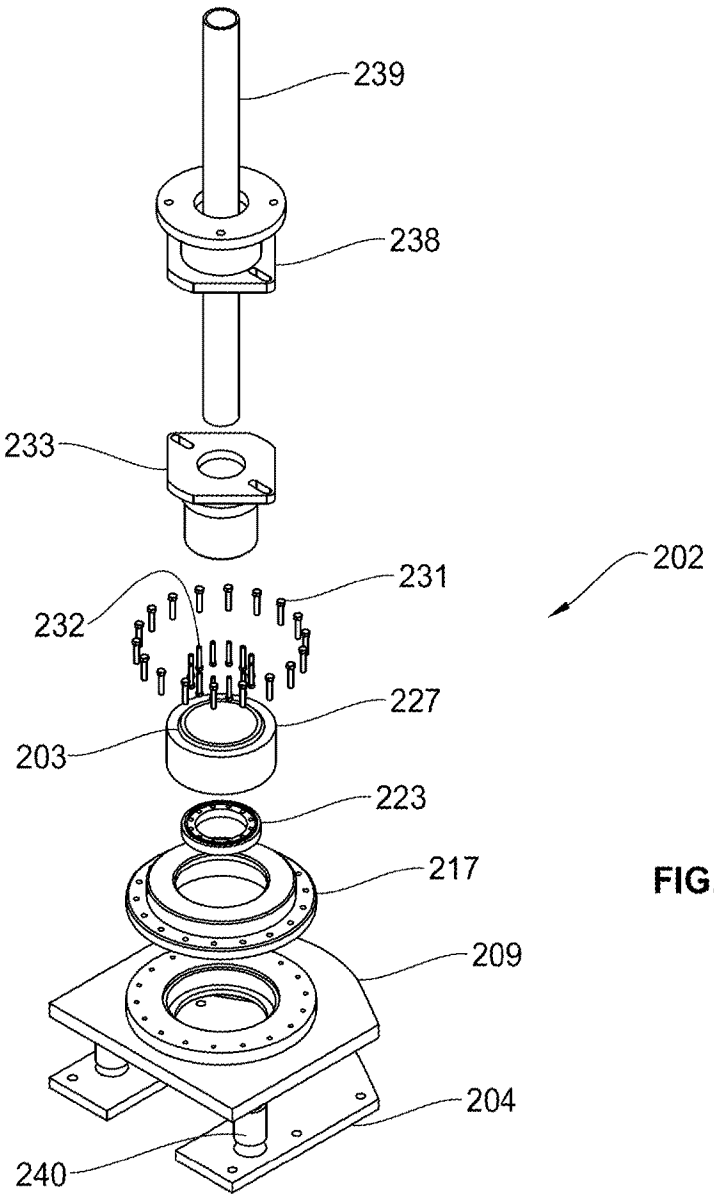
FIG. 9 depicts an exploded view of a motion compensating system according to an alternative embodiment.

FIG. 9 depicts an exploded view of a motion compensating system (202) according to an alternative embodiment. The system (202) is usable on a vessel during well intervention operations through a riser. In an embodiment, the vessel may be a jack-up boat. The motion compensation system includes a first floor (204) that is connected to a second floor (209) via a plurality of hydraulic cylinders (240). A bearing retainer (217) is attachable to the second floor (209) by, for example, screws or bolts (231), and houses a spherical bearing (227) between the second floor (209) and the bearing retainer (217). The spherical bearing (227) includes a central opening (203) therethrough for the riser (239), to allow angular movement of the riser (239) relative to the first floor (204) and the second floor (209) as discussed below. An insert bearing sleeve (233) is at least partially located inside the central opening (203) of the spherical bearing (227). One end of the insert bearing sleeve (233) is attachable to the base of a slip bowl (238), and the other end of the insert bearing sleeve (233) is attachable via, for example, screws or bolts (232), to a lower insert bearing (223) provided below the second floor (209) (see FIG. 16C). Each of the first floor (204), the second floor (209), the bearing retainer (217), the insert bearing sleeve (233) and the slip bowl (238) have an opening therethrough for the riser (239), and each opening is aligned with the central opening (203) of the spherical bearing (227). Each component of the motion compensating system (202) is discussed in more detail below.

Figure 10A:
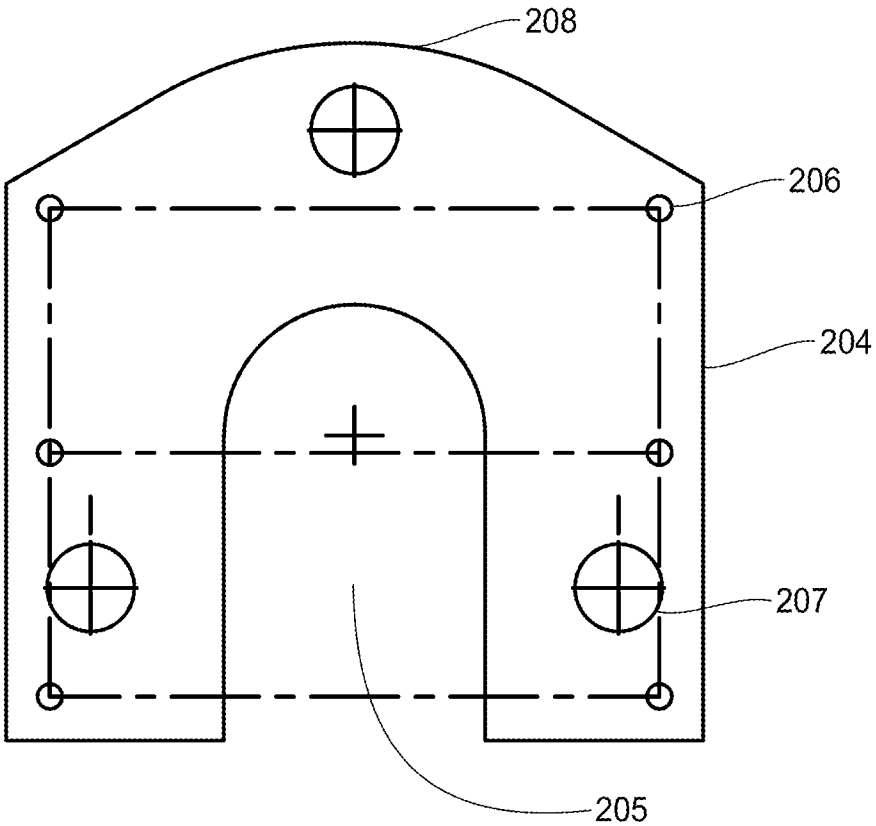
FIGS. 10A and 10B depict a first floor of the motion compensating system according to an embodiment.
Figure 10B:
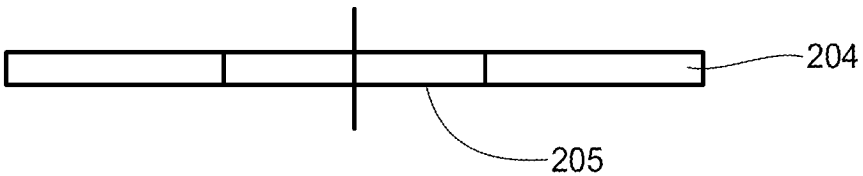

FIGS. 10A and 10B depict an embodiment of the first floor (204) of the motion compensating system (202). In one embodiment, the first floor (204) may be formed of carbon steel. In any embodiment, the material forming the first floor (204) should provide the first floor (204) with a strength to withstand stresses within the limits of API Specification 8C. FIG. 10A shows a top view of the first floor (204), and FIG. 10B shows a side view of the first floor (204). FIG. 10A shows that the first floor (204) may have an overall "U" shape, such that an opening (205) is provided through the first floor (204). The opening (205) allows the riser (239) to pass through the first floor (204). The first floor (204) may also include a rounded section (208). The first floor (204) may also include a plurality of bolt holes (206) for securing the first floor (204) to the deck or hull of a vessel. In the illustrated embodiment, six bolt holes (206) are provided. In other embodiments, the number of bolt holes (206) may be less than or greater than six. Also illustrated in FIG. 10A are the locations (207) for the hydraulic cylinders (240). The locations a (207) are provided around the opening (205) of the first floor (204), and are connected to the second floor (209) around an opening (210) of the second floor (209) (shown in FIG. 11A, discussed below). The illustrated locations are exemplary and non-limiting, as the locations (207) may be provided on other areas on the surface of the first floor (204). In the illustrated embodiment, three locations (207) are provided. However, the number locations may be less than or greater than three. The design is scalable and dimensions may be selected depending on the particular application of the motion compensating system (202) in an operating environment. In the illustrated embodiment, there are a total of three hydraulic cylinders (240) connecting the first floor (204) to the second floor (209). However, the system (202) may include more or less than three hydraulic cylinders (240).

Figure 11C:
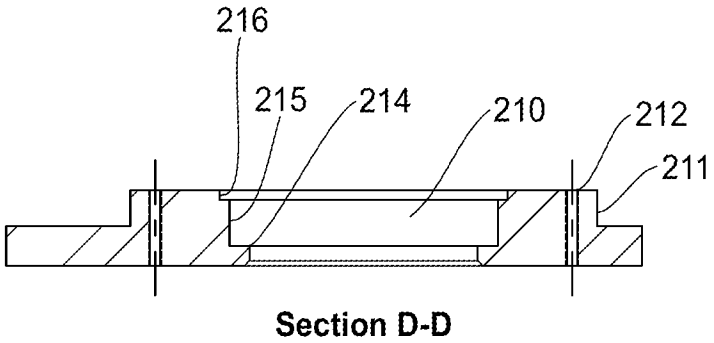
FIGS. 11A to 11D depict a second floor of the motion compensating system according to an embodiment.
Figure 11D:
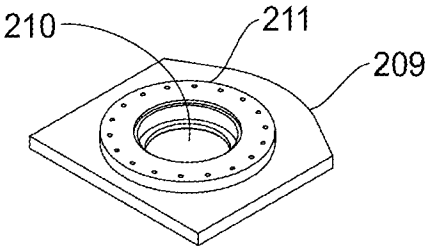
Figure 11A:
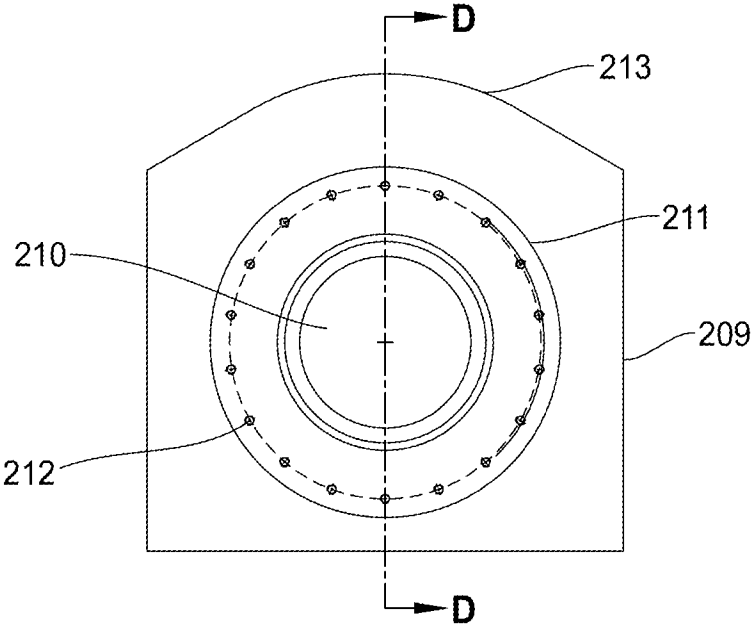
Figure 11B:
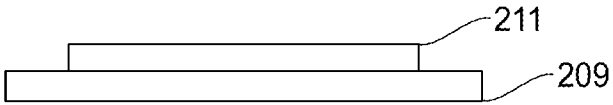

FIGS. 11A to 11D depict an embodiment of the second floor (209) of the motion compensating system (202). In one embodiment, the second floor (209) may be formed of carbon steel. In any embodiment, the material forming the second floor (209) should provide the first floor (204) with a strength to withstand stresses within the limits of API Specification 8C. FIG. 11A shows a top view of the second floor (209), FIG. 11B shows a side view of the second floor (209), FIG. 11C shows a cross-sectional side view of the second floor (209), and FIG. 11D illustrates an isomeric view of the second floor (209). The second floor (209) includes the opening (210), which aligns with the opening (205) in the first floor (204), to allow the riser (239) to pass through the second floor (209). A ridge (211) is provided on the top surface of the second floor (209) and includes bolt holes (212) for attaching with the bearing retainer (217) via the screws or bolts (231). The ridge (211) includes an inner shoulder (214) and an extended inner wall (215) for housing the spherical bearing (227) (as shown in FIG. 11C). A recess (216) may be provided at the edge of the opening (210). The recess (210) may be engageable with a portion of the bearing retainer (217) for correctly locating the bearing retainer (217) relative to the second floor (209) so that the bolt holes (212) align with the bolt holes (218) (see FIG. 12A) of the bearing retainer (217). The second floor (209) may also include a rounded section (213), as shown in FIG. 11A.

The hydraulic cylinders (240), or other linear actuators, as depicted in FIG. 9, can be pivotally mounted to the first floor (204) and the second floor (209) and can be usable to raise and lower the second floor (209) away from and toward the first floor (204), responsive to movement of the vessel or other structure upon which the motion compensating system (202) is installed. The hydraulic cylinders (240) may be similar to the one discussed above, and may be configured as discussed above to provide for improved stability and motion control of the second floor (209), allowing heave, pitch, roll, and yaw motion compensation. Although the hydraulic cylinders (240) are shown connected in a specific configuration, it should be understood that other cylinder configurations or arrangements can be used without departing from the scope of the present disclosure. Furthermore, it should be understood that cylinder stroke lengths and dimensions, bore sizes, the number of cylinders used, as well as the hydraulic fluid pressures and flows required to properly operate the system can be varied depending on specific desired load and/or reaction times (e.g., based on the riser and expected forces/motions), the vessel with which the system is to be used, and other variables. Cylinders designed to be powered by other fluids, such as air or nitrogen, are also usable within the scope of the present invention. Due to the properties of nitrogen which allow rapid movement of the cylinders, nitrogen is the preferred fluid for use in the cylinders.

The hydraulic cylinders (240) can extend and retract simultaneously to compensate for the heave motion of the vessel or other structure. For example, if the vessel moves closer to the sea floor because it enters the trough of a wave, the hydraulic cylinders (240) can extend upward, thereby moving the second floor (209) upward to compensate for the downward displacement of the first floor (204). If the vessel moves away from the sea floor because it enters the crest of a wave, the hydraulic cylinders (240) can retract, thereby moving the second floor (209) downward, to compensate for the upward displacement of the first floor (204). To compensate for pitch, roll, and yaw motions of the vessel, the hydraulic cylinders (240) can be extended and retracted independently from each other to change the tilt or the vertical angle of the second floor (209) with respect to the first floor (204) to reduce or eliminate the motion of the second floor (209) as the vessel tilts or changes the vertical angle.

Figure 12C:
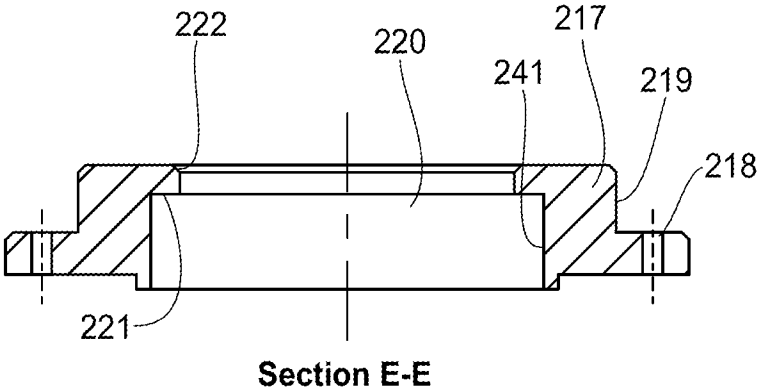
FIGS. 12A to 12D depict a bearing retainer of the motion compensating system according to an embodiment.
Figure 12D:
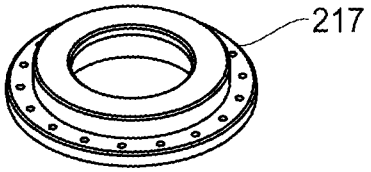
Figure 12A:
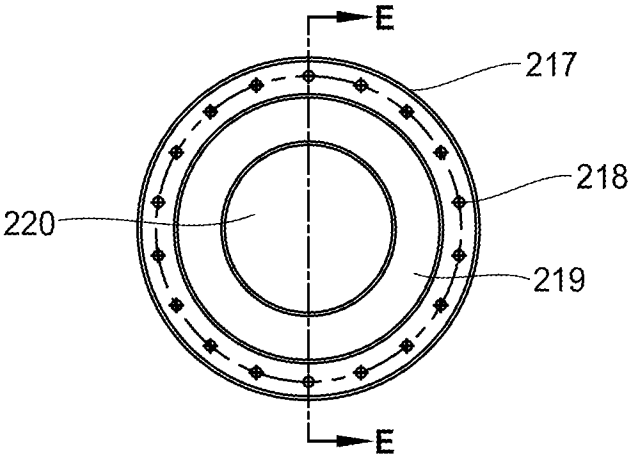
Figure 12B:
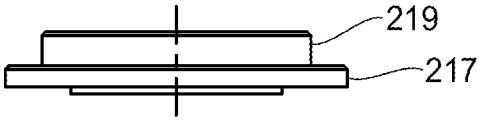
Figure 17C:
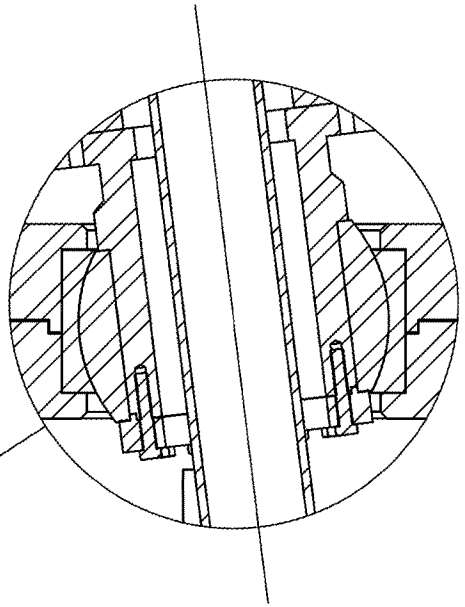
FIGS. 17A to 17D depict views of the motion compensating system during angular movement of a riser according to an embodiment.
Figure 17D:
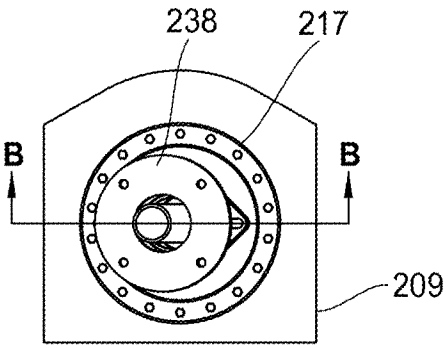
Figure 17B:
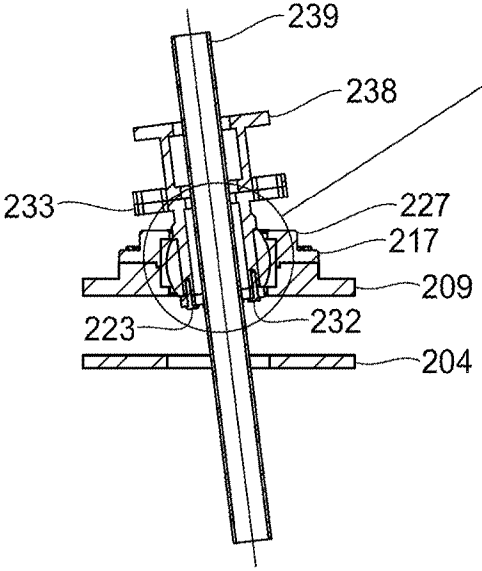
Figure 17A:
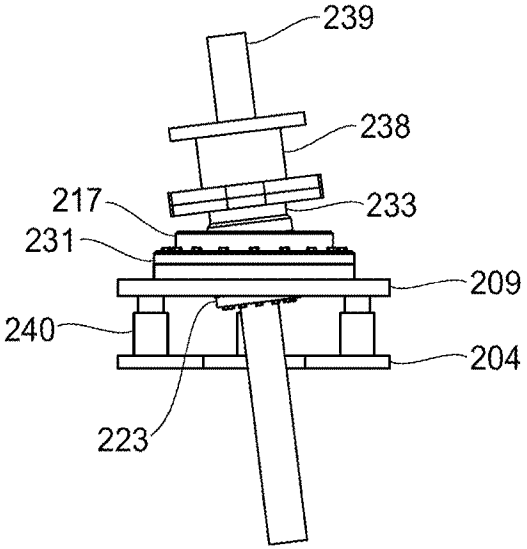

FIGS. 12A to 12D depict an embodiment of the bearing retainer (217) of the motion compensating system (202). In one embodiment, the bearing retainer (217) may be formed of carbon steel. FIG. 12A shows a top view of the bearing retainer (217), FIG. 12B shows a side view of the bearing retainer (217), FIG. 12C shows a cross-sectional side view of the bearing retainer (217), and FIG. 12D illustrates an isomeric view of the bearing retainer (217). The bearing retainer (217) includes an opening (220), which aligns with the opening (205) in the first floor (204) and the opening (210) in the second floor (209), to allow the riser (239) to pass through the bearing retainer (217). Bolt holes (218) are provided on the bearing retainer (217) for attaching the bearing retainer (217) to the second floor (209) via the screws or bolts (231). A ridge (219) is provided on the top surface of the bearing retainer (217), and ridge (219) may include an inner shoulder (221) and an extended inner wall (241) for housing the spherical bearing (227). A recess (222) may be provided at the edge of the opening (220). The recess (222) can provide a space for angular movement of the insert bearing sleeve (233) when the riser (239) is angularly moved (see FIGS. 17B and 17C).

Figure 13C:
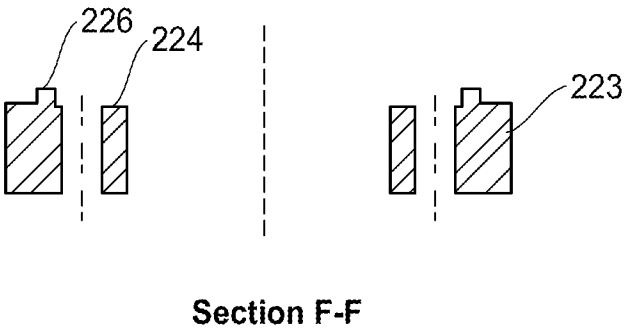
FIGS. 13A to 13D depict an internal sleeve flange of the motion compensating system according to an embodiment.
Figure 13D:
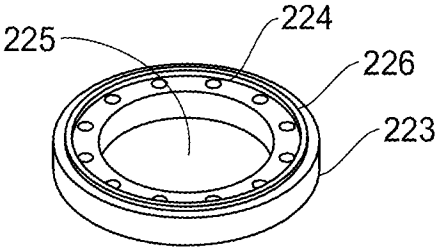
Figure 13A:
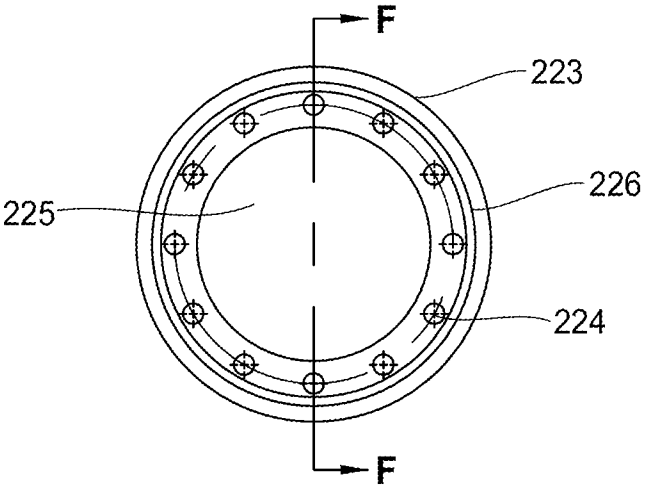
Figure 13B:
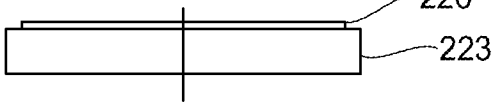

FIGS. 13A to 13D depict an embodiment of the internal sleeve flange (223) of the motion compensating system (202). In one embodiment, the internal sleeve flange (223) may be formed of carbon steel. FIG. 13A shows a top view of the internal sleeve flange (223), FIG. 13B shows a side view of the internal sleeve flange (223), FIG. 13C shows a cross-sectional side view of the internal sleeve flange (223), and FIG. 13D illustrates an isomeric view of the internal sleeve flange (223). The internal sleeve flange (223) includes an opening (225), which aligns with the opening (205) in the first floor (204), the opening (210) in the second floor (209), and the opening (220) in the bearing retainer (217) to allow the riser (239) to pass through the internal sleeve flange (223). Bolt holes (224) are provided on the internal sleeve flange (223) for attaching the internal sleeve flange (223) to a bottom portion of the insert bearing sleeve (233) via the screws or bolts (232). A ridge (226) is provided on the top surface of the internal sleeve flange (223). The ridge (226) may be engageable with a portion of the insert bearing sleeve (233) for correctly locating the internal sleeve flange (223) relative to the insert bearing sleeve (233).

Figure 14:
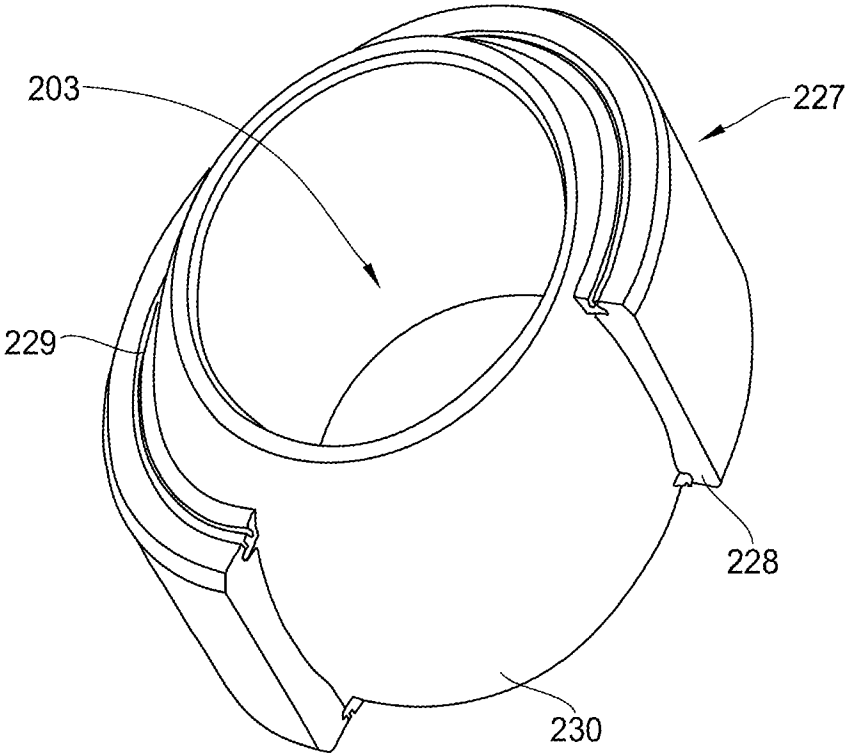
FIG. 14 depicts a spherical bearing of the motion compensating system according to an embodiment.

FIG. 14 depicts an embodiment of the spherical bearing (227) of the motion compensating system (202). The spherical bearing comprises an outer ring (228) and a spherical inner ring (230). In the figure, a portion of the outer ring (228) is cut away to show more of the spherical inner ring (230). Upper and lower shields (229) may be provided on opposed circumferential edges of the outer ring (228). The spherical inner ring (230) is rotatable (360) degrees relative to the outer ring (228), and is also movable from side to side (see, e.g., FIG. 17C). The components of the spherical bearing (227) may be formed of carbon steel. The outer ring is configured to be encased between the bearing retainer (217) and the ridge (211) (e.g., the extended inner wall (215) of the ridge (211)) of the second floor (209). The inner ring (230) includes an opening (203), which aligns with the opening (205) in the first floor (204), the opening (210) in the second floor (209), the opening (220) in the bearing retainer (217), and the opening (225) of the internal sleeve flange (223), to allow the riser (239) to pass through the spherical bearing (227).

Figure 15A:
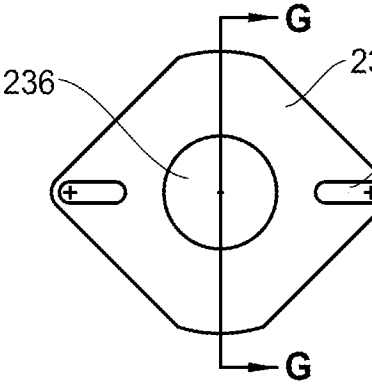
FIGS. 15A to 15E depict an insert bearing sleeve of the motion compensating system according to an embodiment.
Figure 15B:
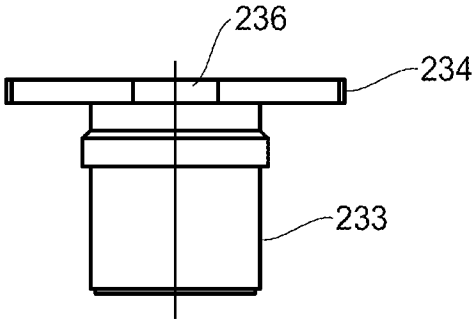
Figure 15C:
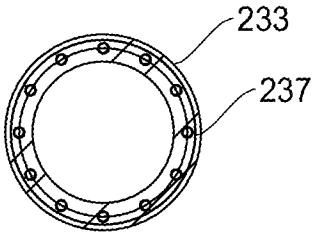
Figure 15D:
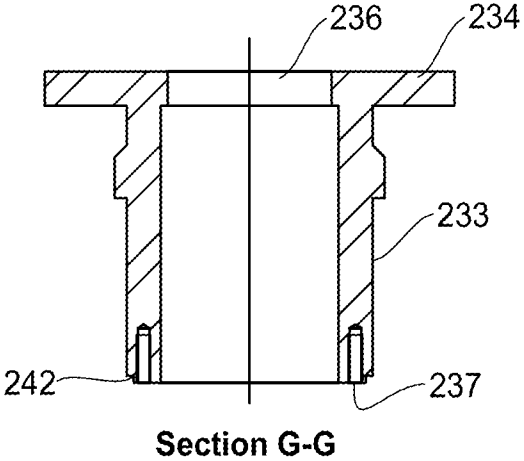
Figure 15E:
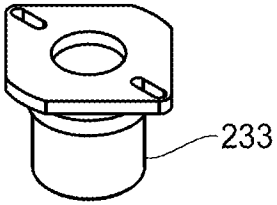

FIGS. 15A to 15E depict an embodiment of the insert bearing sleeve (233) of the motion compensating system (202). In one embodiment, the insert bearing sleeve (233) may be formed of structural steel. FIG. 13A shows a top view of the insert bearing sleeve (233), FIG. 13B shows a side view of the insert bearing sleeve (233), FIG. 13C shows a bottom view of the insert bearing sleeve (233), FIG. 13D shows a cross-sectional side view of the insert bearing sleeve (233), and FIG. 13E illustrates an isomeric view of the insert bearing sleeve (233). The insert bearing sleeve (233) includes an opening (236), which aligns with the opening (205) in the first floor (204), the opening (210) in the second floor (209), the opening (220) in the bearing retainer (217), the opening (225) of the internal sleeve flange (223), and the opening (203) of the spherical bearing (227), to allow the riser (239) to pass through the insert bearing sleeve (233). The top part of the insert bearing sleeve (233) comprises an outwardly extending flange (234). The flange (234) includes bolt holes (235) for attaching the insert bearing sleeve (233) to the slip bowl (238). The flange (234) shown in FIG. 15A is substantially diamond shaped, but the shape is not limited thereto. The shape may be circular, rectangular, or other polygonal shape. The bottom part of the insert bearing sleeve (233) comprises bolt holes (237) for attaching the insert bearing sleeve (233) to a top portion of the insert bearing sleeve (233) via the screws or bolts (232). A recess (242) may be provided at the bottom part of the insert bearing sleeve (233). The recess (242) may be engageable with the ridge (226) of the internal sleeve flange (223) for correctly locating the insert bearing sleeve (233) relative to the internal sleeve flange (223) so that the bolt holes (237) align with the bolt holes (224) on the internal sleeve flange (223) (see FIG. 16D).

FIGS. 16A to 16D depict views of an assembled motion compensating system (202) according to an embodiment.

Figure 16A:
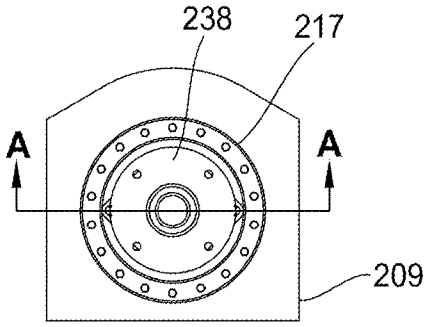
FIGS. 16A to 16D depict views of an assembled motion compensating system according to an embodiment.
Figure 16C:
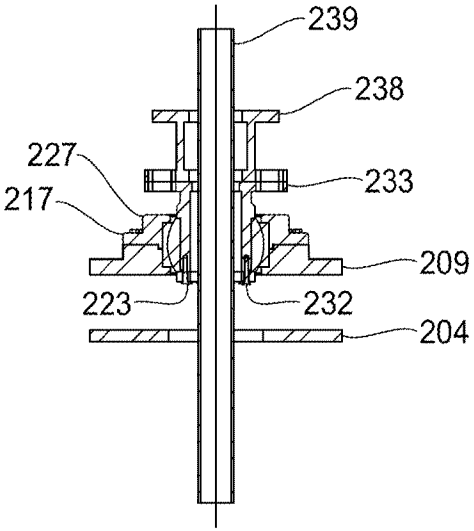
Figure 16D:
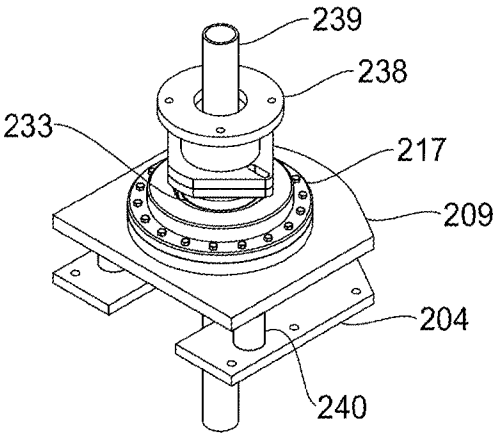
Figure 16B:
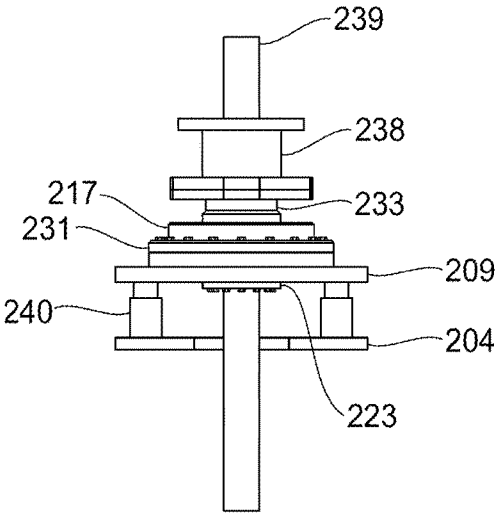

FIG. 16A shows a top view of the system (202), FIG. (136)B shows a side view of the system (202), FIG. 16C shows a cross-sectional side view of the system (202), and FIG. 16D illustrates an isomeric view of the system (202). FIGS. 16B to 16D show that the first floor (204) is connected to the second floor (209) via the hydraulic cylinders (240). As shown in FIG. 16C, the spherical bearing (227) is housed between the second floor (209) and the bearing retainer (217), and the bearing retainer (217) is attached to the second floor (209) via, e.g., screws or bolts (231). The insert bearing sleeve (233) is at least partially located inside the central opening (203) of the spherical bearing (227), and is attached at its lower end to the lower insert bearing (223) via, e.g., screws or bolts (232). The upper end of the insert bearing sleeve (233) is attached to the base of the slip bowl (238). The opening (205) in the first floor (204), the opening (210) in the second floor (209), the opening (220) in the bearing retainer (217), the opening (225) of the internal sleeve flange (223), the opening (203) of the spherical bearing (227), the opening (236) in the insert bearing sleeve (233), and the opening in the slip bowl (238) all align with each other so that the riser (239) passes through the motion compensating system (202) as shown in FIGS. 16B to 16D.

FIGS. 17A to 17D depict views of the motion compensating system (202) during angular movement of a riser (239). As the riser (239) moves angularly relative to the system (202), for example due to heave, pitch, roll, and yaw motion of the vessel or other structure upon which the system (202) is installed, the insert bearing sleeve (233) and the slip bowl (238) move angularly with the riser (239) via the spherical bearing (227). The system thus compensates for relative motion between the riser (239) and the vessel, enabling various operations to be performed in, on, and/or through the riser (239) riglessly, independent of heave forces and other motions.

Figure 18:
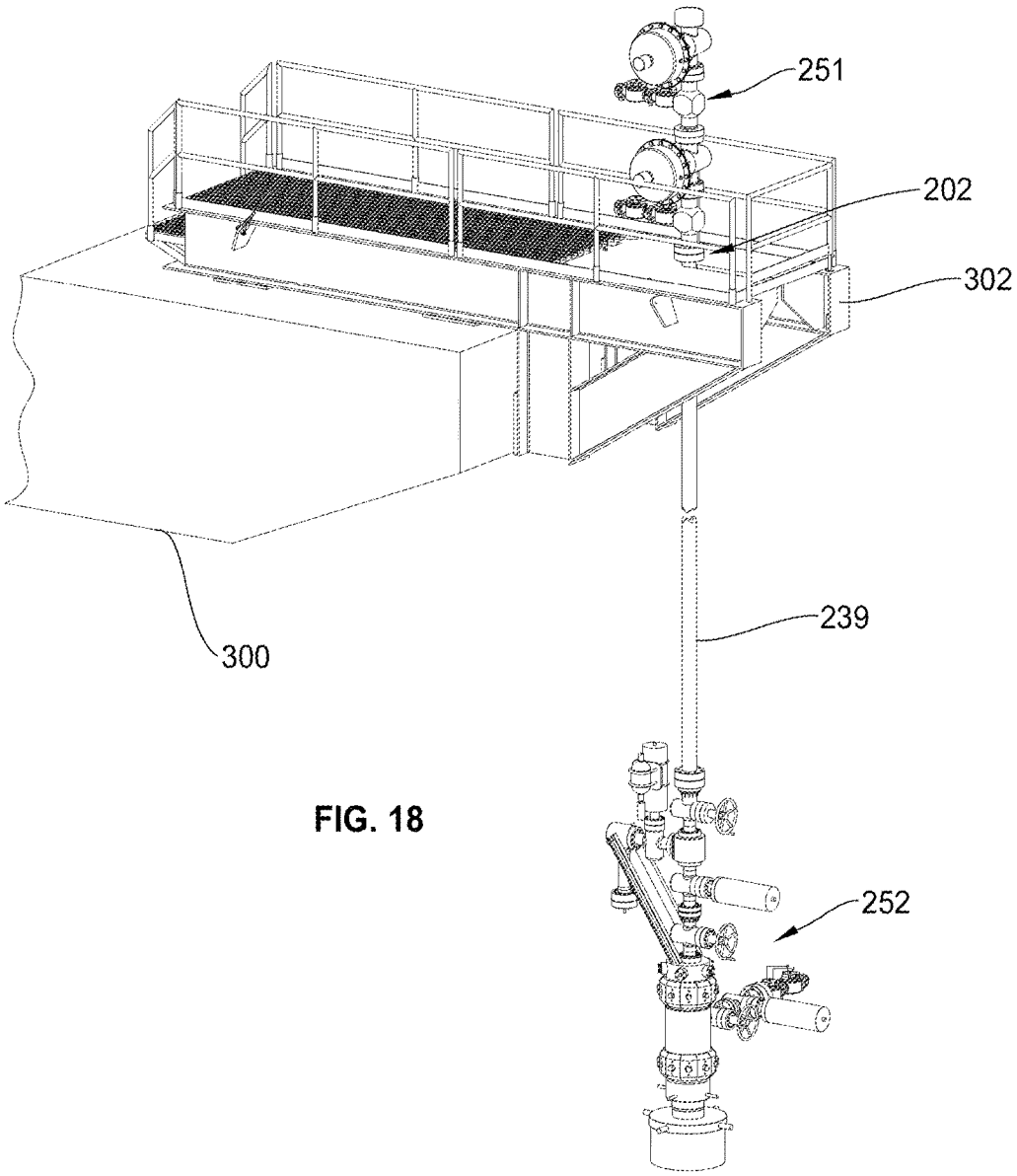
FIG. 18 depicts an environment in which the motion compensating system is used according to an embodiment.

FIG. 18 shows an example of the motion compensating system (202) provided on a lift boat (300), in which the system (202) is located on a cantilever portion (302) of the lift boat. The system (202) accommodates a rise (239) extending between subsea devices (252) and surface devices (251). Surface devices (251) are depicted here as a valve stack, which may comprise air control valves, manual valves, hydraulic power unit (HPU) valves, or combinations thereof. These surface devices (251) may thus enable manual control or override of the system (202).

A method for compensating for relative motion between a vessel, a heave floor unit, and a subsea riser (239) may include attaching the heave floor unit to a deck or hull of the vessel. The heave floor unit includes the first floor (204) is attached to the deck or hull; the second floor (209); a plurality of hydraulic cylinders (240) connecting the first floor (204) to the second floor (209); the bearing retainer (217) attached to the second floor (209); a spherical bearing (227) provided between the second floor (209) and the bearing retainer (217), wherein the spherical bearing (227) includes a central opening (203) therethrough for the riser (239) to allow angular movement of the riser (239) relative to the heave floor unit; an insert bearing sleeve (233) at least partially located inside the central opening (203) of the spherical bearing (227); and a slip bowl (238) attached to the insert bearing sleeve (233). Each of the first floor (204), the second floor (209), the bearing retainer (217), the insert bearing sleeve (233) and the slip bowl (238) have an opening therethrough that is aligned with the central opening (203) of the spherical bearing (227). The method further includes inserting the subsea riser (239) through the central opening (203) of the spherical bearing (227) and the opening of the first floor (204), the second floor (209), the bearing retainer (217), the insert bearing sleeve (233) and the slip bowl (238); and actuating the plurality of hydraulic cylinders (240) in response to motion of the vessel relative to the second floor (209), and in response to motion of the heave floor unit relative to the angular movement the subsea riser (239).

The present disclosure thereby provides systems and methods usable to compensate for relative motion between a riser and a vessel, and/or between a riser and an inner coiled tubular or tool string, enabling various operations to be performed in, on, and/or through a riser riglessly, independent of heave forces and other motions.

While various embodiments usable within the scope of the present disclosure have been described with emphasis, it should be understood that within the scope of the appended claims, the present invention can be practiced other than as specifically described herein. It should be understood by persons of ordinary skill in the art that an embodiment of the motion compensating floor system (10, 100) in accordance with the present disclosure can comprise all of the features described above. However, it should also be understood that each feature described above can be incorporated into the motion compensating floor system (10, 100) by itself or in combinations, without departing from the scope of the present disclosure.

The invention claimed is:

1. A motion compensating system usable on a vessel during well intervention operations through a riser, the motion compensation system comprising:

a first floor;

a second floor;

a plurality of hydraulic cylinders connecting the first floor to the second floor;

a bearing retainer attachable to the second floor;

a spherical bearing provided between the second floor and the bearing retainer, wherein the spherical bearing includes a central opening therethrough for the riser to allow angular movement of the riser relative to the first floor and the second floor;

an insert bearing sleeve at least partially located inside the central opening of the spherical bearing; and a slip bowl attachable to the insert bearing sleeve, wherein each of the first floor, the second floor, the bearing retainer, the insert bearing sleeve and the slip bowl have an opening therethrough for the riser, and each opening is aligned with the central opening of the spherical bearing.

2. A motion compensating system according to claim 1, wherein each of the plurality of hydraulic cylinders is pivotally connected to the first floor and the second floor for moving the first floor with respect to the second floor.

3. A motion compensating system according to claim 1, wherein the plurality of hydraulic cylinders are connected to the first floor around the opening of the first floor, and connected to the second floor around the opening of the second floor.

4. A motion compensating system according to claim 1, wherein a total of three hydraulic cylinders connect the first floor to the second floor.

5. A motion compensating system according to claim 1, wherein the first floor is configured to be attached to a deck or a hull of the vessel over a moon pool of the vessel.

6. A motion compensating system according to claim 1, wherein the vessel is a jack-up boat.

7. A motion compensating system according to claim 1, wherein the insert bearing sleeve and the slip bowl move angularly with the angular movement of the riser.

8. A motion compensating system according to claim 1, wherein the spherical bearing comprises an outer ring and a spherical inner ring, and the outer ring is encased between the bearing retainer and the second floor.

9. A method for compensating for relative motion between a vessel, a heave floor unit, and a subsea riser, the method comprising:

attaching the heave floor unit to a deck or a hull of the vessel, the heave floor unit comprising:

a first floor that is attached to the deck or the hull, a second floor, and a plurality of hydraulic cylinders connecting the first floor to the second floor;

a bearing retainer attached to the second floor;

a spherical bearing provided between the second floor and the bearing retainer, wherein the spherical bearing includes a central opening therethrough for the riser to allow angular movement of the riser relative to the heave floor unit;

an insert bearing sleeve at least partially located inside the central opening of the spherical bearing; and a slip bowl attached to the insert bearing sleeve, wherein each of the first floor, the second floor, the bearing retainer, the insert bearing sleeve and the slip bowl have an opening therethrough that is aligned with the central opening of the spherical bearing;

inserting the subsea riser through the central opening of the spherical bearing and the opening of the first floor, the opening of the second floor, the bearing retainer, the insert bearing sleeve and the slip bowl; and actuating the plurality of hydraulic cylinders in response to motion of the vessel relative to the second floor, and in response to motion of the heave floor unit relative to the angular movement the subsea riser.

10. The method according to claim 9, wherein the plurality of hydraulic cylinders are actuated to keep the second floor at a constant level, and to keep the subsea riser at a constant tension.

11. The method according to claim 9, wherein the step of actuating the plurality of hydraulic cylinders comprises differentially actuating individual hydraulic cylinders within the plurality of hydraulic cylinders in response to a pitch motion, a roll motion, a yaw motion, or combinations thereof, by the vessel.

12. The method according to claim 9, wherein the heave floor unit is attached to the deck or the hull of the vessel over a moon pool of the vessel.

13. The method according to claim 9, wherein the heave floor unit is attached to a cantilever portion of the vessel.

* * * * *